US007950861B2

(12) United States Patent
Hattori et al.

(10) Patent No.: US 7,950,861 B2
(45) Date of Patent: May 31, 2011

(54) OPENING-ANGLE RESTRICTING DEVICE

(75) Inventors: Yoshiteru Hattori, Ichinomiya (JP); Hiroshi Igarashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1032 days.

(21) Appl. No.: 11/755,978

(22) Filed: May 31, 2007

(65) Prior Publication Data

US 2008/0003045 A1 Jan. 3, 2008

(30) Foreign Application Priority Data

Jun. 30, 2006 (JP) ..... 2006-181405

(51) Int. Cl.
*B41J 29/02* (2006.01)

(52) U.S. Cl. ..... 400/693; 220/375; 220/810; 312/315

(58) Field of Classification Search ..... 400/693
See application file for complete search history.

(56) References Cited

U.S. PATENT DOCUMENTS

| | | | | | |
|---|---|---|---|---|---|
| 414,404 | A * | 11/1889 | Grogg | ..... | 312/315 |
| 865,114 | A * | 9/1907 | Mapes | ..... | 312/110 |
| 2,249,932 | A * | 7/1941 | Beal | ..... | 49/109 |
| 2,411,713 | A * | 11/1946 | Denison | ..... | 312/292 |
| 2,833,270 | A * | 5/1958 | Brown et al. | ..... | 126/191 |
| 2,871,084 | A * | 1/1959 | Gardner | ..... | 312/310 |
| 7,029,006 | B2 * | 4/2006 | Izumi et al. | ..... | 271/145 |

FOREIGN PATENT DOCUMENTS

| | | |
|---|---|---|
| EP | 0027749 | 4/1981 |
| JP | 4615184 | 5/1971 |
| JP | 5414557 | 6/1979 |
| JP | 54175422 | 12/1979 |
| JP | 56067073 | 6/1981 |
| JP | 5960292 | 4/1984 |
| JP | 62173481 | 11/1987 |
| JP | 251674 | 10/1988 |
| JP | 6437258 | 3/1989 |
| JP | 6443188 | 3/1989 |
| JP | 2134299 | 11/1990 |
| JP | 479199 | 7/1992 |
| JP | 51774 | 1/1993 |
| JP | 632685 | 4/1994 |
| JP | 648513 | 7/1994 |
| JP | 665170 | 9/1994 |
| JP | 6270687 | 9/1994 |
| JP | 6272460 | 9/1994 |
| JP | 8127244 | 5/1996 |

(Continued)

*Primary Examiner* — Jill E Culler
(74) *Attorney, Agent, or Firm* — Banner & Witcoff, Ltd.

(57) ABSTRACT

An opening-angle restricting device includes a main casing, a cover member, a string member, a take-up unit, and a stopper unit. The main casing has an inner space for accommodating an image forming unit that forms an image on a recording medium. The cover member is coupled to the main casing via a hinge. The cover member has an inner side that faces the inner space when the cover member is closed. The string member has one end fixed to the main casing. The take-up unit is provided at the inner side of the cover member. The take-up unit is configured to pay out and take up the string member. The stopper unit restricts paying out of the string member when an amount of payout in the string member reaches a predetermined amount, thereby restricting an opening angle of the cover member at a predetermined angle.

8 Claims, 15 Drawing Sheets

FOREIGN PATENT DOCUMENTS

| | | |
|---|---|---|
| JP | 9126470 | 5/1997 |
| JP | 10261155 | 9/1998 |
| JP | 11129576 | 5/1999 |
| JP | 2001281771 | 10/2001 |
| JP | 2003013661 | 1/2003 |
| JP | 2004123166 | 4/2004 |
| JP | 2004258149 | 9/2004 |
| JP | 2004278103 | 10/2004 |
| JP | 2005041629 | 2/2005 |
| JP | 2005091482 | 4/2005 |
| JP | 2005141020 | 6/2005 |

* cited by examiner

OPENING-ANGLE RESTRICTING DEVICE

CROSS REFERENCE TO RELATED APPLICATIONS

This application claims priority from Japanese Patent Application No. 2006-181405 filed Jun. 30, 2006. The entire content of the priority application is incorporated herein by reference.

TECHNICAL FIELD

The invention relates to an opening-angle restricting device employed in an image forming apparatus.

BACKGROUND

Conventionally, image forming apparatuses have employed various covers. A variety of techniques have been proposed for restricting the opening angle of such covers with connecting members linking the cover to the body of the image forming apparatus. Generally, linkages or string members have been used as the connecting members. However, image forming apparatuses using linkages must allocate a special space for accommodating the linkages when the cover is closed, making it more difficult to produce a more compact device. String members require less space than linkages and are therefore preferable from the perspective of producing a compact image forming apparatus. Japanese Patent Application Publication No. 2001-281771 gives one example of an image forming apparatus employing string members (wires) as cover connecting members.

SUMMARY

When the cover in the image forming apparatus disclosed in Japanese Patent Application Publication No. 2001-281771 is opened to a predetermined angle, the wires connected to the cover become taut, restricting the cover from opening farther. However, if the connecting members simply restrict the angle at which the cover can be opened, the jerky and jolting feeling of the cover being opened and closed is not a pleasant feeling, particularly when the cover is opened vigorously.

In view of the foregoing, it is an object of the invention to provide an opening-angle restricting device for restricting the angle in which a cover is opened while achieving excellent opening and closing operability, without unduly taking up space in the main body of the apparatus.

In order to attain the above and other objects, the invention provides an opening-angle restricting device. The opening-angle restricting device includes a main casing, a cover member, a string member, a take-up unit, and a stopper unit. The main casing has an inner space for accommodating an image forming unit that forms an image on a recording medium. The cover member is coupled to the main casing via a hinge. The cover member has an inner side that faces the inner space when the cover member is closed. The string member has one end fixed to the main casing. The take-up unit is provided at the inner side of the cover member. The take-up unit is configured to pay out and take up the string member. The stopper unit restricts paying out of the string member when an amount of payout in the string member reaches a predetermined amount, thereby restricting an opening angle of the cover member at a predetermined angle.

According to another aspect, the invention also provides an opening-angle restricting device. The opening-angle restricting device includes a main casing, a cover member, a string member, a take-up unit, and a stopper unit. The main casing has an inner space for accommodating an image forming unit that forms an image on a recording medium. The cover member is coupled to the main casing via a hinge and is swingably movable about a swing axis that extends in an axial direction. The cover member has both ends in the axial direction. The string member has both ends that are fixed to respective ones of the both ends of the cover member. The take-up unit is provided at the main casing. The take-up unit is configured to pay out and take up the string member. The take-up unit has a plurality of pulleys including at least one movable pulley. The string member is looped around the plurality of pulleys such that the both ends of the string member are free ends capable of being paid out from the take-up unit. The stopper unit restricts paying out of the string member when an amount of payout in the string member reaches a predetermined amount, thereby restricting an opening angle of the cover member at a predetermined angle.

BRIEF DESCRIPTION OF THE DRAWINGS

Embodiments in accordance with the invention will be described in detail with reference to the following figures wherein.

DETAILED DESCRIPTION

First Embodiment

An opening-angle restricting device according to a first embodiment of the invention will be described while referring to FIGS. 1 through 11.

In the following description, the expressions "front", "rear", "upper", "lower", "right", and "left" are used to define the various parts when an image forming apparatus employing the opening-angle restricting device is disposed in an orientation in which it is intended to be used.

Figure 1:
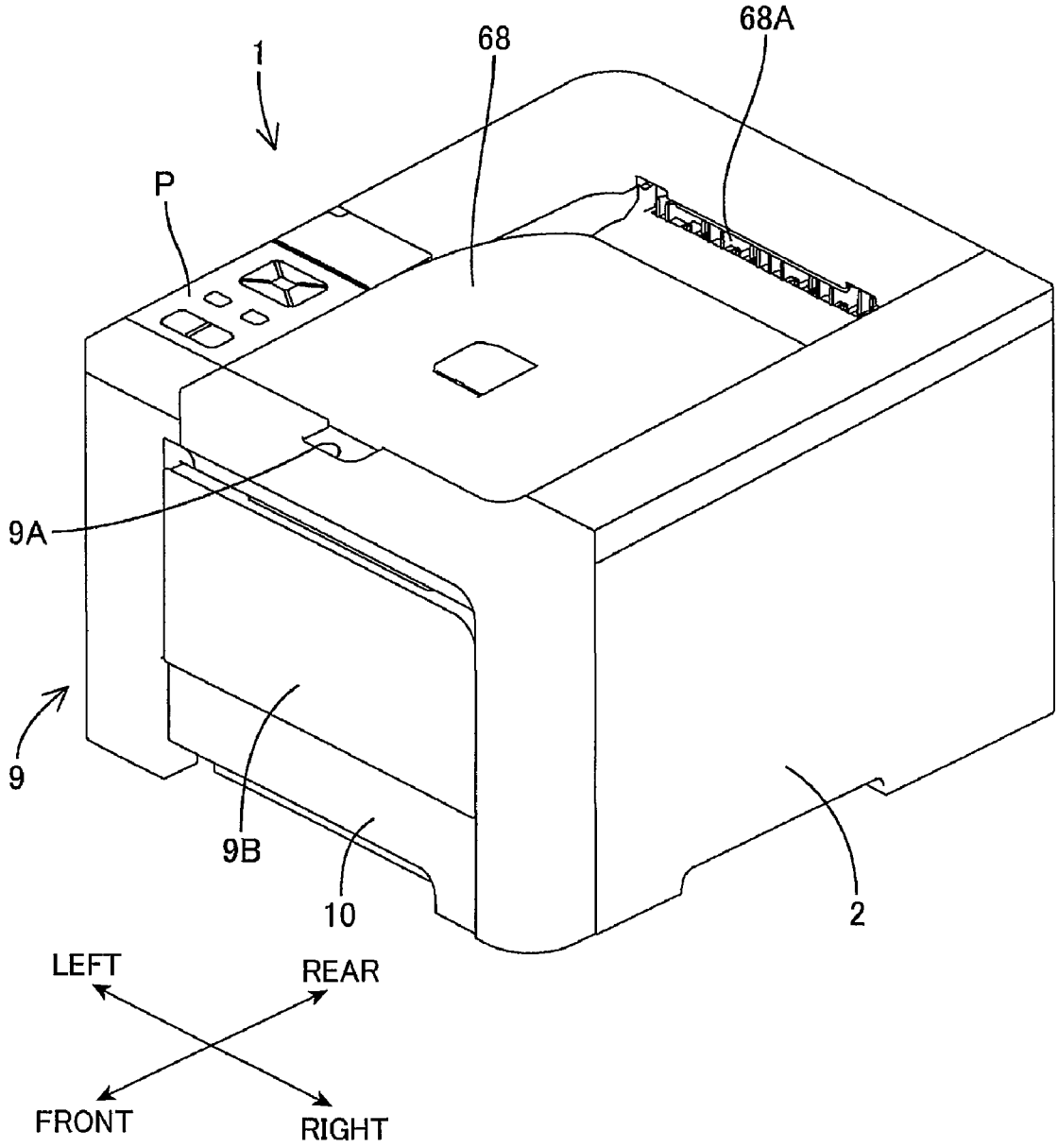
FIG. 1 is a perspective view of a laser printer according to a first embodiment of the invention.
Figure 2:
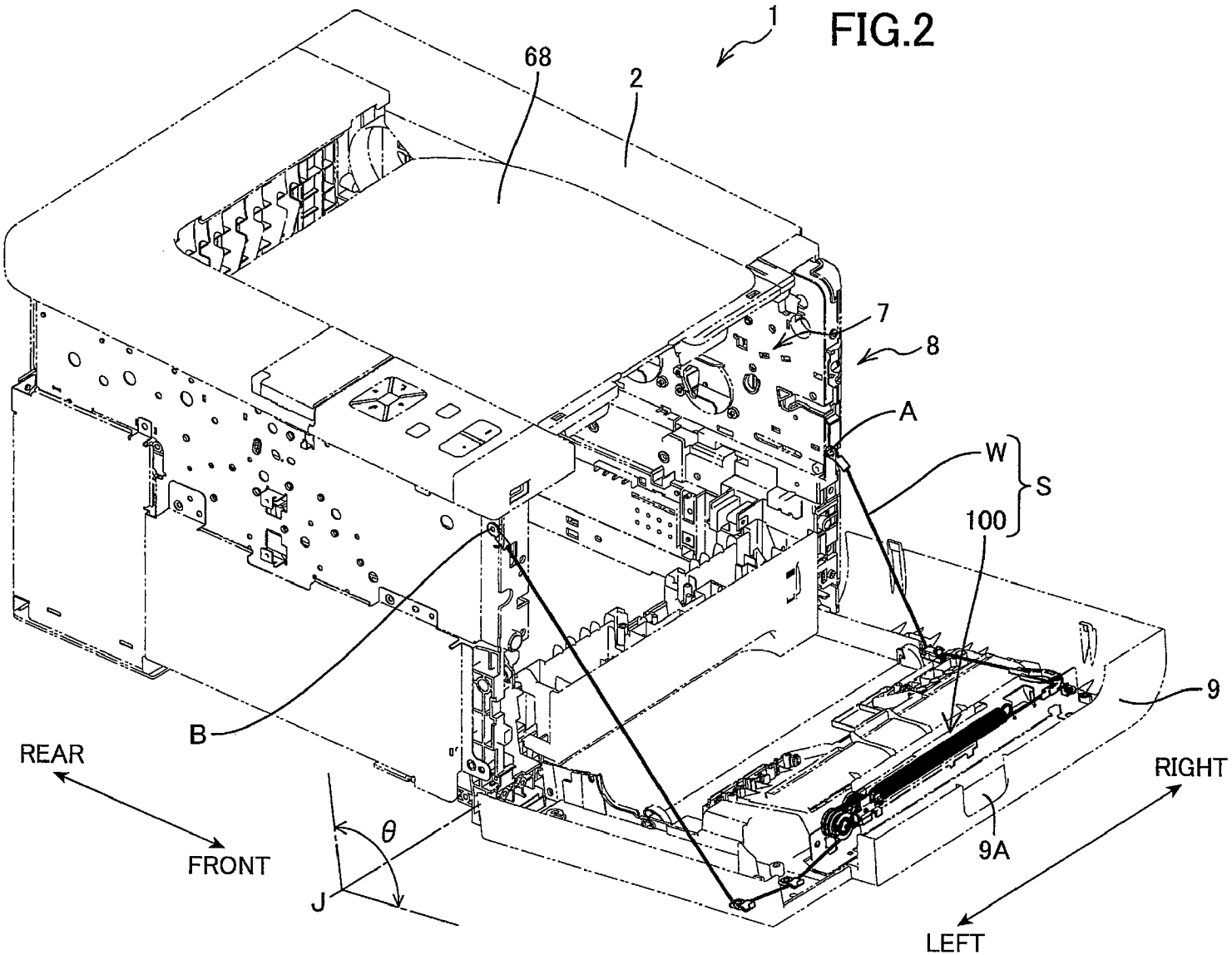
FIG. 2 is a perspective view of the laser printer when a front cover is opened.

As shown in FIGS. 1 and 2, a printer 1 according to the first embodiment includes a main casing 2 having a box shape that is open on the front side.

As shown in FIG. 1, a top surface of the main casing 2 is recessed so that a widthwise center portion of the surface slopes slightly downward toward the rear side, forming a discharge tray 68. A discharge opening 68A is formed in the main casing 2 at the rear side of the discharge tray 68. After an image is formed on a sheet of paper 3, the sheet is discharged through the discharge opening 68A toward the front side. A control panel P is disposed in a front portion on the top surface of the main casing 2 to a side of the discharge tray 68.

The printer 1 is provided with a paper cassette 10 and a front cover 9. The paper cassette 10 is detachably mounted in the main casing 2 for accommodating the paper 3 in a stacked state. The paper cassette 10 can be removed from the main casing 2 by pulling the paper cassette 10 toward the near side in FIG. 1.

The front cover 9 is attached to the main casing 2 by hinges having a hinge axis J (FIGS. 2 and 4) and functions together with the front surface of the paper cassette 10 to seal the opening in the front side of the main casing 2. The hinge axis J is provided on the lower front surface of the main casing 2 and couples with the bottom edge of the front cover 9.

An operating part 9A is provided on the top portion of the front cover 9. The user grips the operating part 9A to rotate the front cover 9 about the hinge axis J. Hence, the user can position the front cover 9 in the erected state (closed state) shown in FIG. 1 to seal the opening in the front surface of the main casing 2 or can position the front cover 9 in the forward state (open state) shown in FIG. 2 to expose the opening in the front surface of the main casing 2.

The opening formed in the front surface of the main casing 2 is an access opening 8 that communicates with a drum-accommodating space 7 formed in the main casing 2. When the front cover 9 is swingably moved downward to the forward state shown in FIG. 2, a drum unit 26 described later can be inserted into the drum-accommodating space 7 or removed therefrom via the access opening 8.

The front cover 9 is also provided with a manual feed tray 9B shown in FIG. 1, and an opening-angle (opening-range) restricting device S shown in FIG. 2. The manual feed tray 9B constitutes part of the front cover 9, but is separate from the panel constituting the front cover 9. Accordingly, the user can pull the top edge of the manual feed tray 9B toward the front side in FIG. 1 to place only the manual feed tray 9B in the forward state, while the panel itself remains closed.

The opening-angle restricting device S functions to restrict the angle at which the front cover 9 can be opened to a predetermined angle (an angle θ shown in FIG. 2), thereby preventing the front cover 9 from being opened farther than the state shown in FIG. 2, even when the user attempts to pull the front cover 9 farther forward. The structure of the opening-angle restricting device S will be described in greater detail below.

Figure 3:
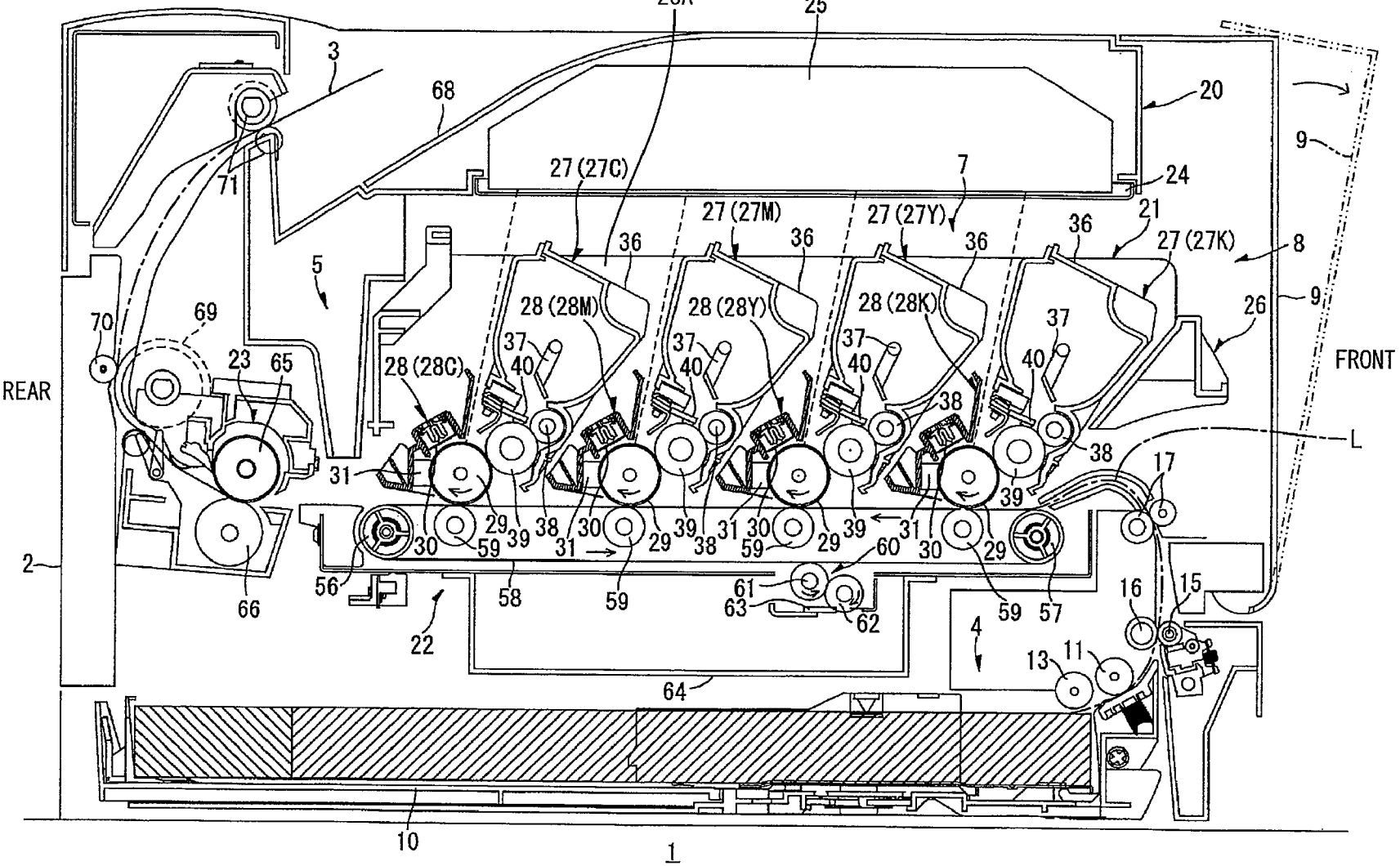
FIG. 3 is a side cross-sectional view of the laser printer.

FIG. 3 is a side cross-sectional view of the printer 1. Next, components constituting the printer 1 will be described briefly with reference to FIG. 3.

The printer 1 is a horizontal tandem-type color laser printer having a plurality of drum subunits 28K, 28Y, 28M, and 28C (hereafter collectively referred to as drum subunits 28) juxtaposed in the front-to-rear direction. Within the main casing 2, the printer 1 also includes a feeding unit 4 for feeding paper to be printed, and an image-forming unit 5 for forming images on the paper 3 fed from the feeding unit 4.

A single-dot chain line in FIG. 3 indicates a paper-conveying path L in the printer 1. The paper-conveying path L follows a U-shaped course from a position above the front end (right end in FIG. 3) of the feeding unit 4 for reversing the conveying direction of the paper 3 approximately 180° toward the rear side and continues toward the rear section of the printer 1. Upon reaching the rear end of the printer 1, the paper-conveying path L follows another U-shaped course for reversing the conveying direction of the paper 3 approximately 180° toward the front side of the printer 1 and continues to the discharge tray 68 provided on the top surface of the main casing 2.

As paper fed from the feeding unit 4 is conveyed along the paper-conveying path L, toner images are formed on the feeding unit 4 in the image-forming unit 5, and the images are fixed to the feeding unit 4 by heat in a fixing unit 23 described later to produce desired color images.

1. Construction of Components in the Laser Printer

A. Structure of the Feeding Unit

The feeding unit 4 is primarily configured of the paper cassette 10, a separating roller 11, and a feeding roller 13. Together with the separating roller 11, the feeding roller 13 extracts and feeds paper stacked in the paper cassette 10 one sheet at a time. Along the paper-conveying path L leading from the feeding unit 4 are provided a paper dust roller 15, a pinch roller 16, and registration rollers 17.

B. Structure of the Image-Forming Unit

The image-forming unit 5 is primarily configured of a scanning unit 20, a process unit 21, a transfer unit 22, and the fixing unit 23.

(B-1) Scanning Unit

The scanning unit 20 is disposed in the upper section of the main casing 2 and includes a support plate 24 extending in the front-to-rear and left-to-right directions, and a scanner 25 fixed to the top surface of the support plate 24. The scanning unit 20 functions to irradiate laser beams in a high-speed scan onto the surfaces of photosensitive drums 29 described later.

(B-2) Process Unit

The process unit 21 includes the four drum subunits 28 mentioned above, and four developer cartridges 27 (27K, 27Y, 27M, and 27C) corresponding to the colors black, yellow, magenta, and cyan. The process unit 21 functions to form toner images on the photosensitive drums 29.

Each of the drum subunits 28 includes the photosensitive drum 29 functioning as an image-bearing member, a Scorotron charger 30, and a cleaning brush 31.

Each of the developer cartridges 27 includes a developer frame 36 accommodating toner, and beneath the developer frame 36, a developing roller 39, a supply roller 38, and a thickness-regulating blade 40. An agitator 37 is disposed in the developer frame 36.

The four drum subunits 28 are retained in a single frame 26A and together with the frame 26A constitute the drum unit 26. The four developer cartridges 27 are detachably mounted in the frame 26A of the drum unit 26.

(B-3) Transfer Unit

The transfer unit 22 is a belt unit configured of a drive roller 56, a follow roller 57, four transfer rollers 59, and an endless paper-conveying belt 58 looped around the drive roller 56 and follow roller 57, as well as the transfer rollers 59 interposed therebetween. The transfer unit 22 functions to transfer toner images formed on the photosensitive drums 29 onto the paper 3.

A cleaning section 60 is disposed on the underside of the paper-conveying belt 58 for cleaning the paper-conveying surface of the belt 58. The cleaning section 60 includes a primary cleaning roller 61, a secondary cleaning roller 62, a scraping blade 63, and a toner recovery unit 64.

(B-4) Fixing Unit

The fixing unit 23 includes a heating roller 65, and a pressure roller 66 disposed in confrontation with the heating roller 65. The fixing unit 23 functions to fix color toner images on the paper 3 with heat after the transfer rollers 59 have transferred toner images onto the paper 3 as the paper 3 passes between the heating roller 65 and the pressure roller 66.

After the images have been fixed on the paper 3, a conveying roller 69 and a pinch roller 70 disposed downstream of the fixing unit 23 along the paper-conveying path L receive and convey the paper 3 to discharge rollers 71 farther downstream. The discharge rollers 71 discharge the paper 3 onto the discharge tray 68.

2. Opening-Angle Restricting Device

Next, the opening-angle restricting device S will be described with reference to FIGS. 4 through 9.

The opening-angle restricting device S is configured of a wire take-up device 100, and a stainless steel wire W (string member or cord-like member). The wire W is configured of thread wire (twist wire) made of multiple stainless steel wires. The wire take-up device 100 is disposed on an inside surface 9C of the front cover 9. The wire take-up device 100 employs a pulley device 110. The wire W is drawn out from both ends of the wire take-up device 100, with ends A and B of the wire W fixed to the front wall surface of the main casing 2 at right and left sides respectively.

Figure 5:
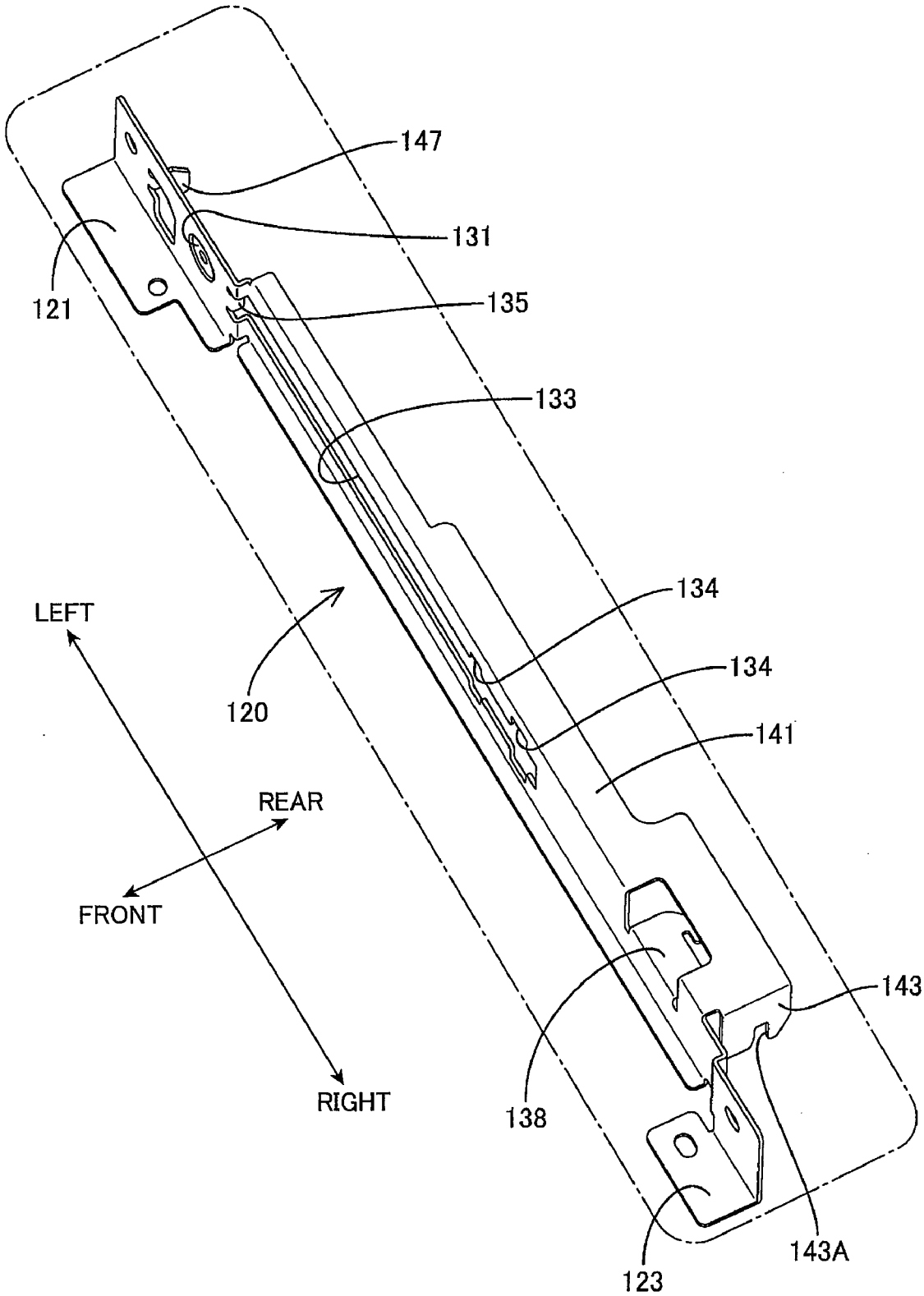
FIG. 5 is a perspective view showing the structure of a pulley retaining plate.

The pulley device 110 includes a pulley retaining plate 120, two pulleys 150 and 160, and the wire W. The pulley retaining plate 120 is formed by pressing a metal plate material having a flat plate shape. As shown in FIG. 5, the pulley retaining plate 120 is elongated along one direction (left-to-right direction in this example) and has fixing parts 121 and 123 on both longitudinal ends for fixing the pulley retaining plate 120 to the front cover 9.

Between the fixing parts 121 and 123 in order from the left side shown in FIG. 5, the pulley retaining plate 120 includes a mounting seat 131, a guide groove 133, and a spring engaging part 138. The mounting seat 131 is formed by punching out part of the plate surface on the pulley retaining plate 120. The pulley 150 is disposed in the mounting seat 131. The guide groove 133 extends in a straight line along the longitudinal direction of the pulley retaining plate 120 and has a uniform groove width along the entire length thereof.

A plate-side stopper part 135 is provided in the pulley retaining plate 120 by bending part of the groove wall at the beginning (left end) of the guide groove 133 toward the rear direction. Further, insertion/removal regions 134 are formed in the end (right end) of the guide groove 133.

The spring engaging part 138 is formed by bending part of the wall surface of the pulley retaining plate 120 toward the rear side. One end of a coil spring 180 (FIG. 4) is engaged in the spring engaging part 138. The coil spring 180 is an example of an urging member.

The pulley retaining plate 120 is also formed with a reinforcing flange 141, shown in FIG. 5. The reinforcing flange 141 overlaps the disposed range of the coil spring 180 with respect the longitudinal direction of the pulley retaining plate 120 (see FIG. 7) and has the effect of increasing the stiffness of the pulley retaining plate 120.

The pulley retaining plate 120 shown in FIG. 5 also includes wire guides 143 and 147.

Next, the pulley 150 and pulley 160 mounted on the pulley retaining plate 120 will be described with reference to FIG. 6A. The pulley 150 is a fixed pulley that is fixedly disposed in the mounting seat 131, as described above, while the pulley 160 is a movable pulley that is slidably fitted into the guide groove 133. However, the shape of the pulleys 150 and 160 themselves (the shape of the cylinder parts about which the wire W is wound) is the same. The cylinder parts of the pulleys 150 and 160 are provided with three wire grooves 155A-155C and 165A-165C, respectively, juxtaposed in the axial direction of the cylinder parts.

However, while the pulley 150 is configured only of the cylinder part, the pulley 160 is also provided with a pulley holder 170. The pulley holder 170 of the pulley 160 is formed of a rotational shaft 171, a spring engaging part 173, a fitting part 177, and a pulley-side stopper piece 179 (a first stopper part). The rotational shaft 171 constitutes the rotational center of the cylinder part of the pulley 160.

Figure 7:
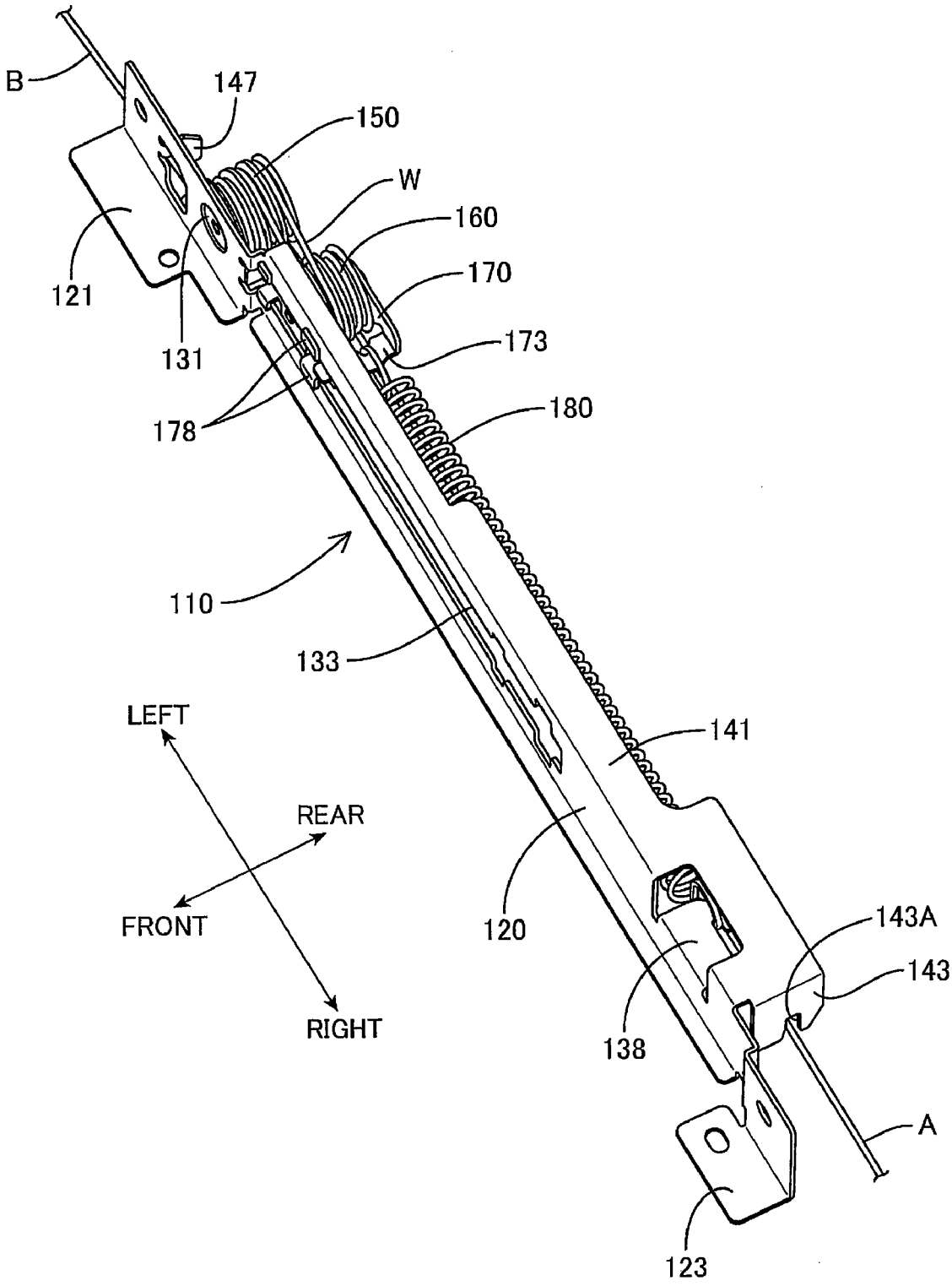
FIG. 7 is a perspective view showing the pulleys and the like mounted on the pulley retaining plate.

The spring engaging part 173 forms a pair with the spring engaging part 138 of the pulley retaining plate 120 (FIG. 5) described above, with the other end of the coil spring 180 engaged in the spring engaging part 173 (FIG. 7).

The pulley-side stopper piece 179 forms a pair with the plate-side stopper part 135 (a second stopper part) of the pulley retaining plate 120 (FIG. 5) described above. The pulley-side stopper piece 179 and the plate-side stopper part 135 constitute a stopper unit.

The fitting part 177 functions to guide advancing and retracting movement of the pulley 160 along the guide groove 133 by fitting into the guide groove 133 with some play. Further, in the present embodiment, the fitting part 177 includes a first fitting part 177A and a second fitting part 177B which are provided on the left and right sides of the pulley 160, respectively. Forming the first and second fitting parts 177A and 177B on the left and right of the pulley 160 in this way enables the pulley 160 to move with stability along the guide groove 133. Further, the front ends of the fitting parts 177 are bent outward to form anchoring parts 178 for preventing the pulley 160 from coming out of the guide groove 133.

As described above, the insertion/removal regions 134 are formed in the rear end of the guide groove 133. By fitting the fitting parts 177 in the insertion/removal regions 134, the pulley 160 can be mounted in the guide groove 133.

Figure 6A:
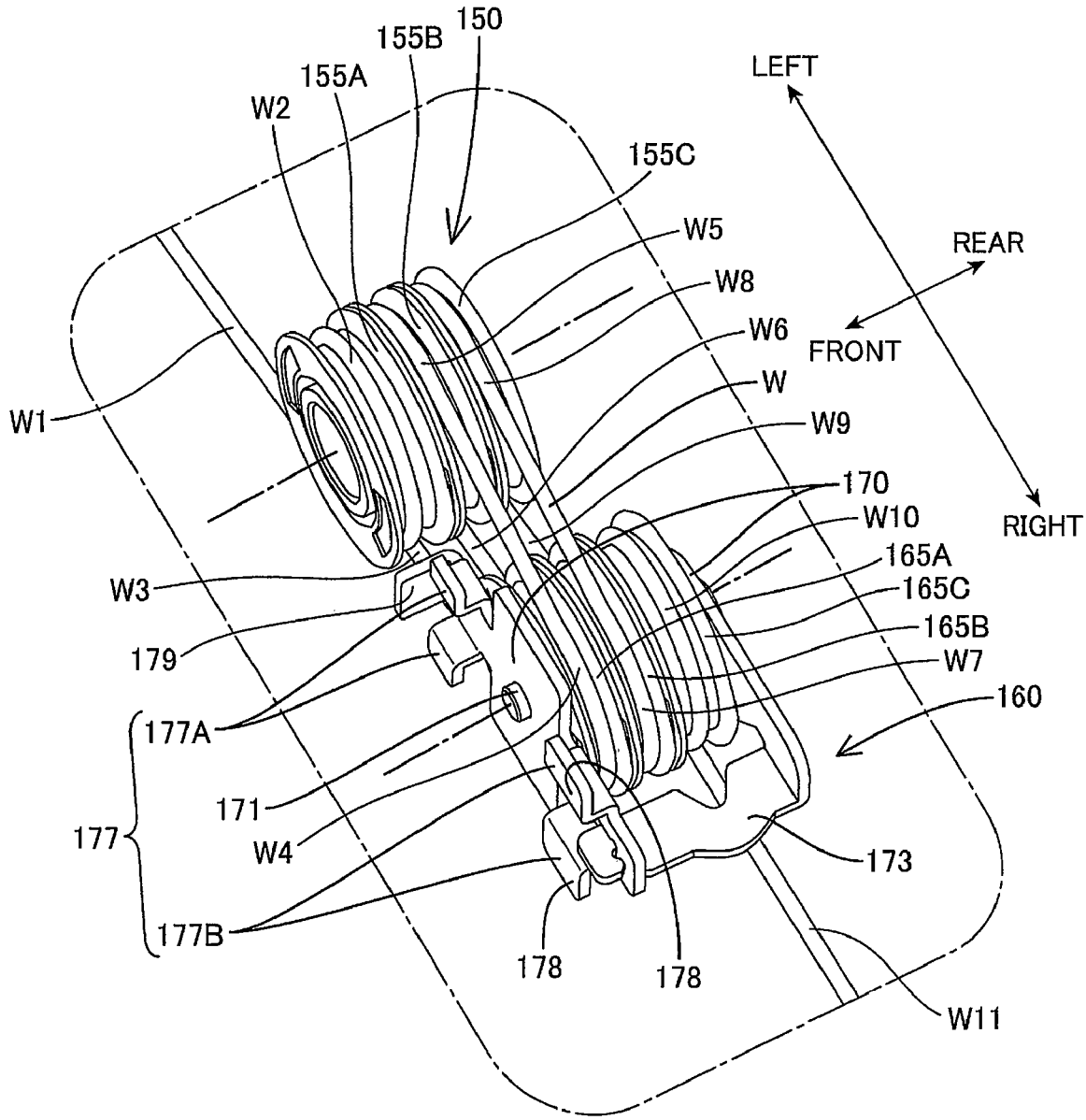
FIG. 6A is a perspective view of wires wound around pulleys.

FIG. 7 shows the components in FIG. 6A mounted on the pulley retaining plate 120. Specifically, the pulley 150 is fixed (capable of rotating about its axis) an the mounting seat 131 of the fixing part 121, while the pulley 160 is slidably disposed in the guide groove 133.

Figure 6B:
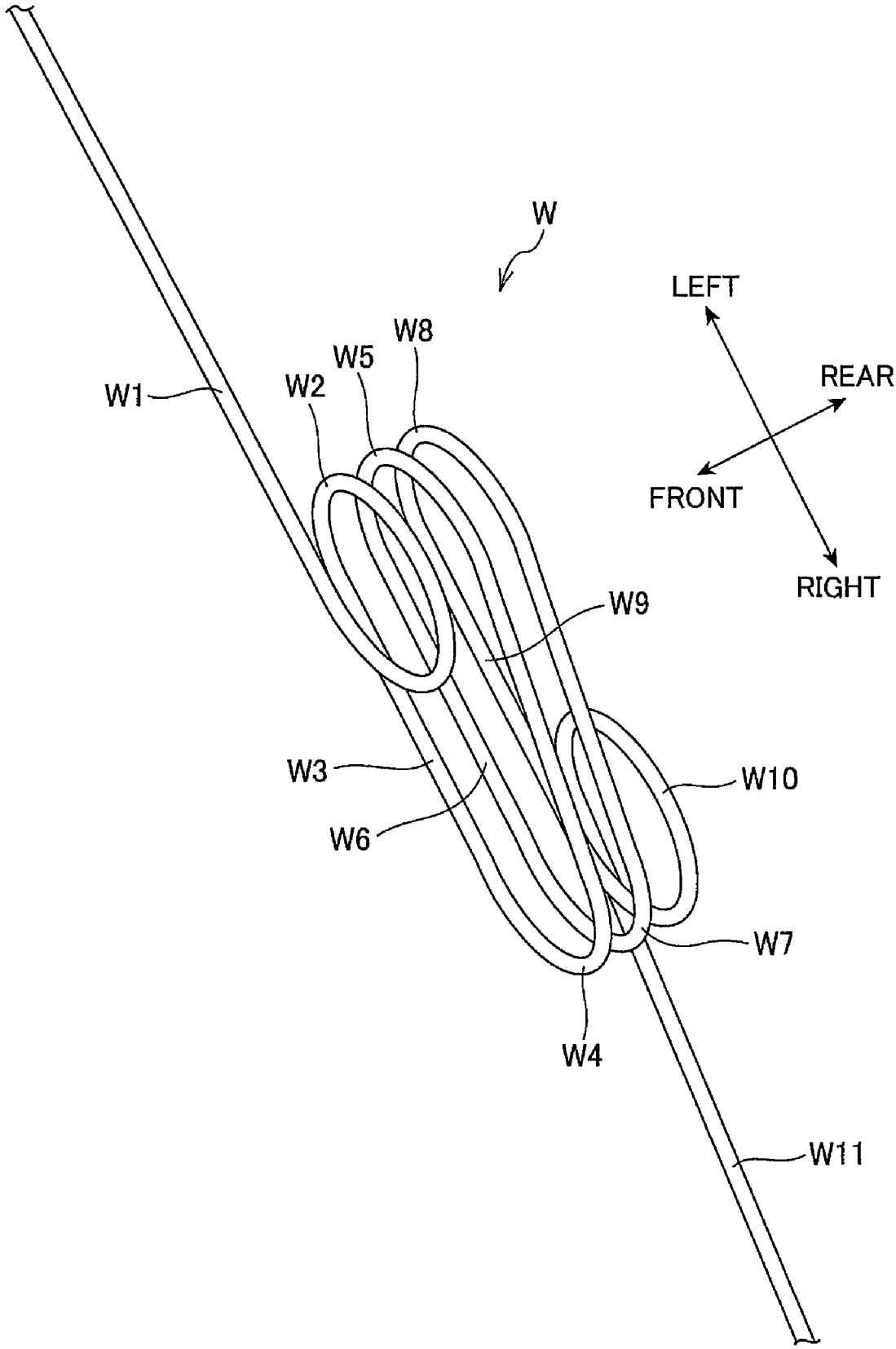
FIG. 6B is an explanatory diagram showing only the wires extracted from FIG. 6A to illustrate the winding method.

The wire W is wound around the wire grooves 155A-155C and 165A-165C of the cylinder parts of the pulleys 150 and 160 so as to span between the pulleys 150 and 160. More specifically, as shown in FIGS. 6A and 6B, the wire W extending from one end (W1) winds once around the wire groove 155A of the pulley 150 (W2) and extends to the pulley 160 (W3). Next, the wire W winds a half turn around the wire groove 165A (W4), winds a half turn around the wire groove 155B of the pulley 150 (W5), and extends back to the pulley 160 (W6). Similarly, the wire W winds a half turn around the wire groove 165B of the pulley 160 (W7), winds a half turn around the wire groove 155C of the pulley 150 (W8), and extends back to the pulley 160 (W9). Finally, the wire W winds once around the wire groove 165C of the pulley 160 (W10) and extends to the other end (W11).

Further, ends A and B of the wire W (FIG. 7) are not fixed to the wire take-up device 100, but can both be freely pulled outward. Specifically, the end A of the wire W is pulled toward the right side in FIG. 7 via a slit 143A formed in the wire guide 143, while the end B of the wire W is pulled toward the left side via the wire guide 147.

The coil spring 180 is attached between the pulley retaining plate 120 and pulley 160. The coil spring 180 functions to urge the pulley 160 toward the right side of the guide groove 133, that is, in a direction for separating the pulley 160 from the pulley 150.

Figure 4:
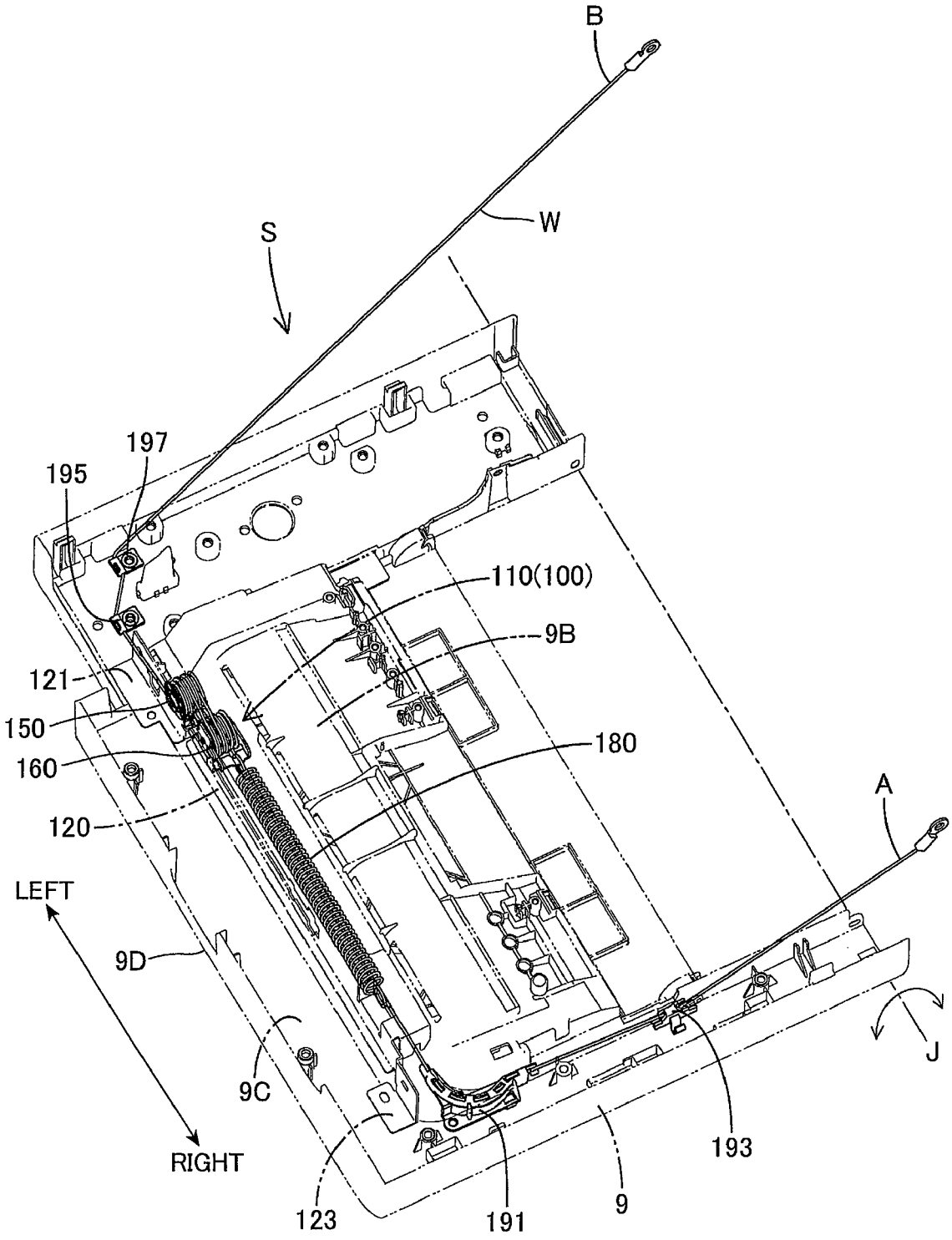
FIG. 4 is a perspective view showing the general structure of an opening-angle restricting device.

As shown in FIG. 4, the wire take-up device 100 having the construction described above is disposed on the inside surface 9C of the front cover 9 at a position near a distal end 9D of the front cover 9, with the longitudinal direction of the wire take-up device 100 following the width (left-to-right) direction of the printer 1.

A pair of wire support pieces 191 and 193 are provided on the right side of the inside surface 9C. The wire support piece 191 is disposed near the corner at the distal end. 9D of the front cover 9 and is arc-shaped. The wire support piece 193 is disposed at a substantially center position between the wire support piece 191 and the hinge axis J.

Figure 8:
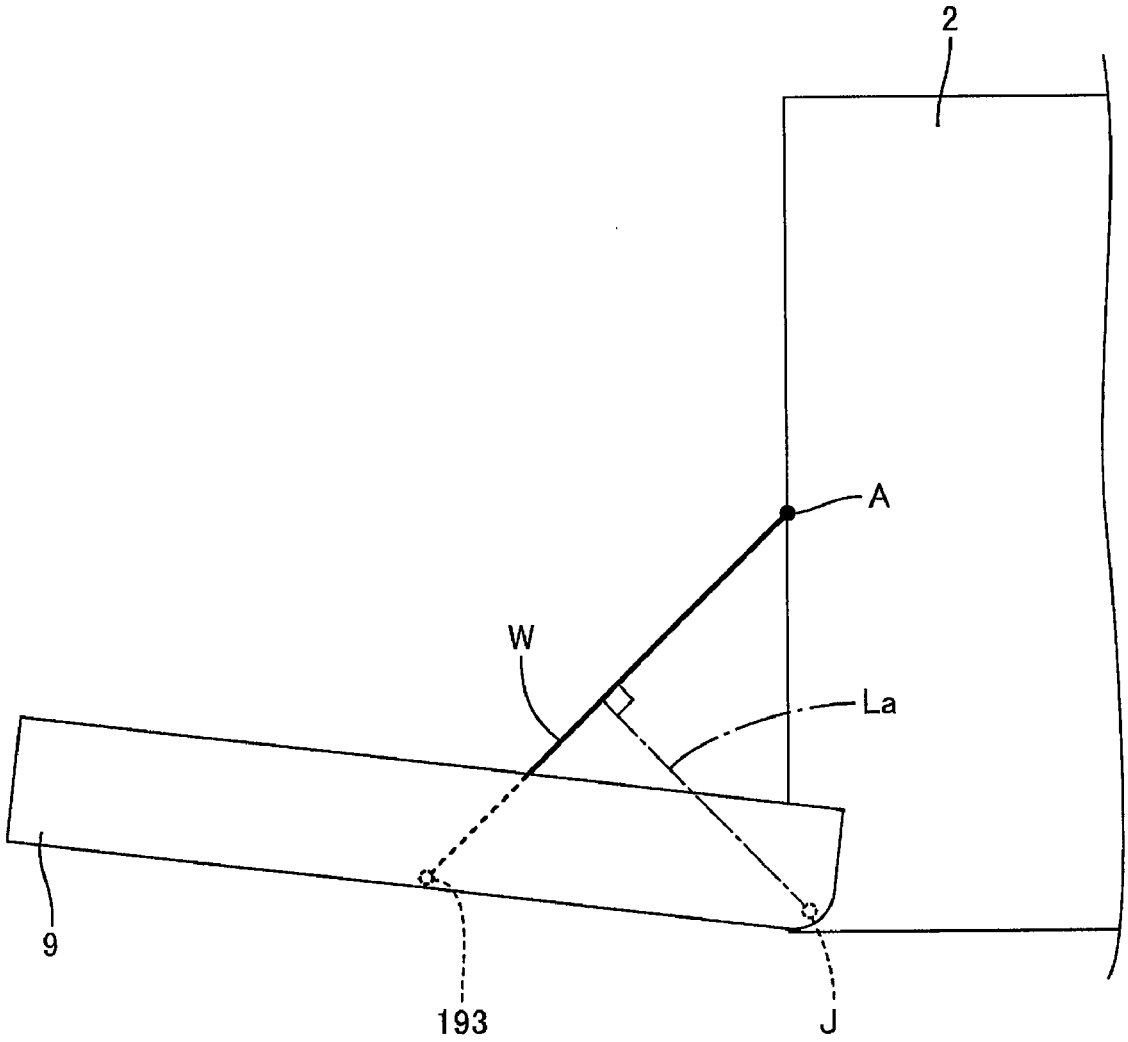
FIG. 8 is a side view showing the extended position of the wire (light side)

With this construction, the end A of the wire W pulled out of the right side of the wire take-up device 100 follows a path that changes about 90° in direction at the corner of the inside surface 9C of the front cover 9 and continues toward the hinge axis J. Finally, the end A of the wire W is pulled out from the wire support piece 193 in the center position and is fixed to the front wall of the main casing 2 at an intermediate point in the height direction, as shown in FIG. 8.

Figure 9:
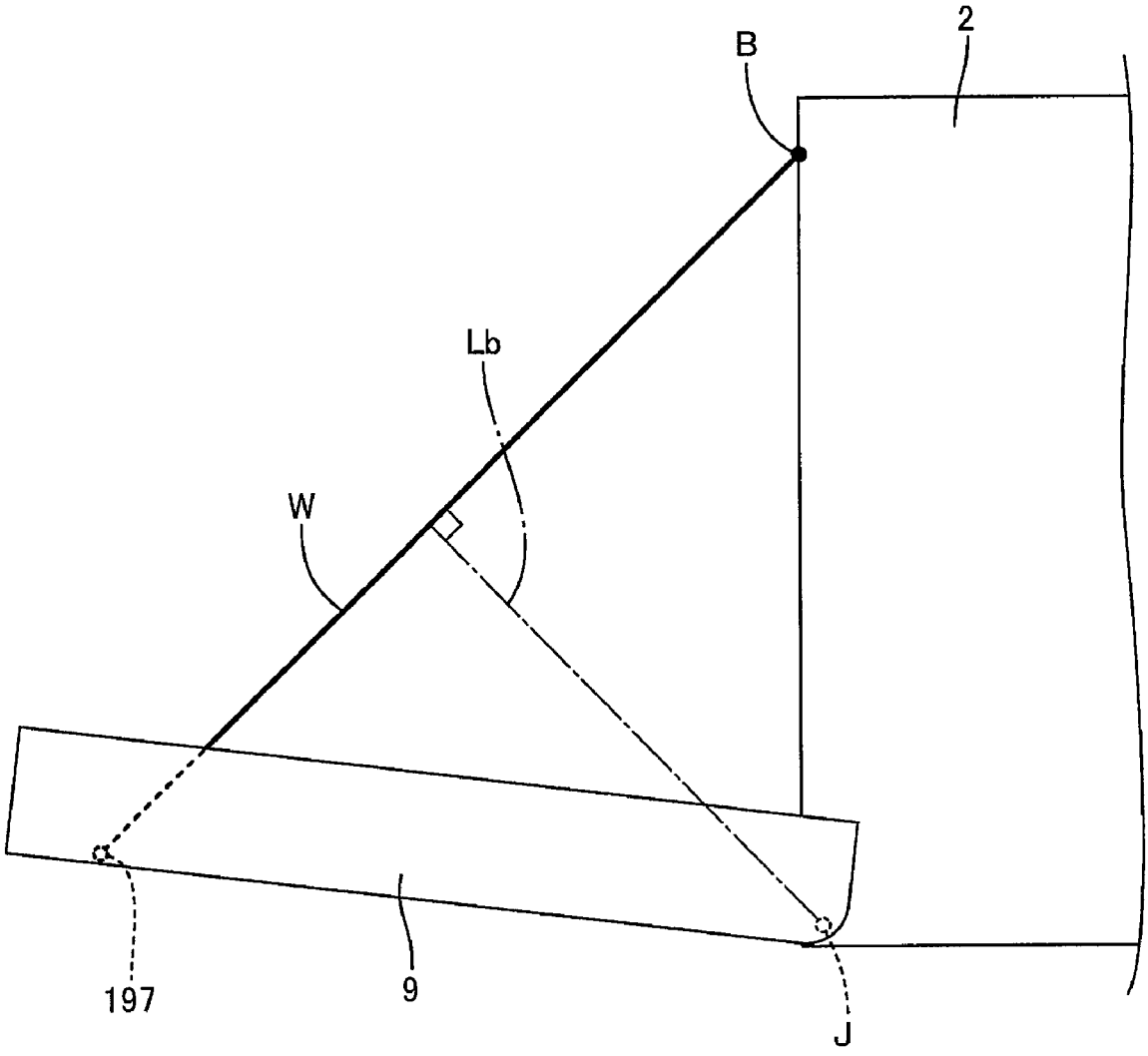
FIG. 9 is a side view showing the extended position of the wire (heavy side)

A pair of wire support pieces 195 and 197 is also provided at the left end of the inside surface 9C of the front cover 9. Both of the wire support pieces 195 and 197 are disposed near the left corner of the inside surface 9C near the distal end 9D of the front cover 9. The end B of the wire W pulled from the left side of the wire take-up device 100 passes through the wire support piece 195 to the wire support piece 197 positioned farther outside of the wire support piece 195, and is pulled out from the wire support piece 197 and is fixed to the front surface of the main casing 2 at a position near the top edge thereof, as shown in FIG. 9.

In this way, the front cover 9 and main casing 2 in the present embodiment are coupled by the wire W, but the extended positions of the wire W differ on the left and right sides of the hinge axis J. The extended position of the wire W on the right side of the device (see FIG. 8) is set relatively near the hinge axis J, while the extended position of the wire W on the left side of the device (see FIG. 9) is set relatively far from the hinge axis J. Hence, the distance from the hinge axis J to the wire W on the left side of the device (Lb in FIG. 9) is greater than the distance on the right side (La in FIG. 8).

Next, opening and closing operations of the front cover 9 will be described.

Figure 10:
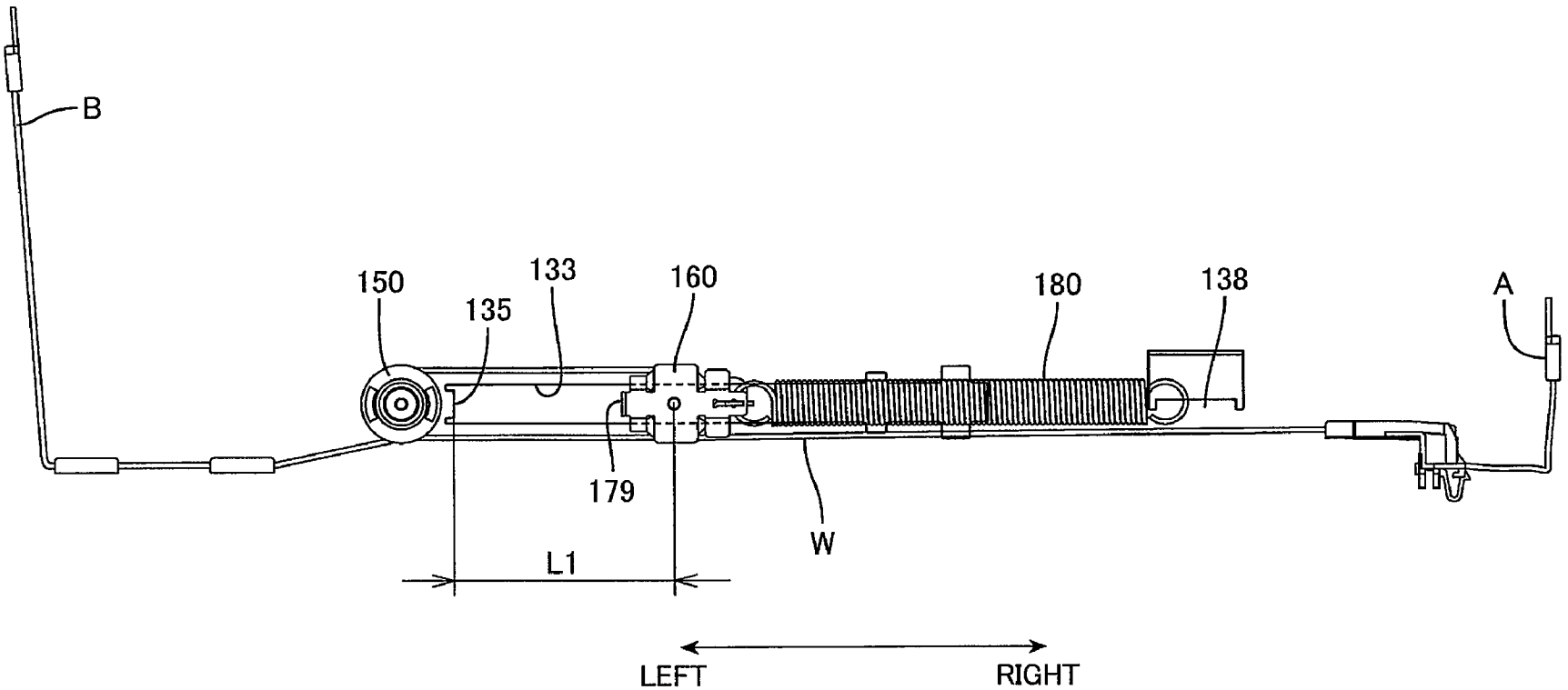
FIG. 10 is a side view showing the positional relationship of the pulleys when the front cover is in an erected state (closed state)

First, when the front cover 9 is closed over the access opening 8 formed in the main casing 2, as shown in FIG. 10, the pulley 160 is halted at a position a distance L1 from the pulley 150.

From this state, if the user grips the operating part 9A provided on the top of the front cover 9 and applies force, the pulley 160 begins to move toward the pulley 150 as the coil spring 180 expands at the point that the operating force exceeds the urging force of the coil spring 180. Since the distance between the pulleys 150 and 160 grows smaller at this time, the wire W is paid out from the wire take-up device 100. Consequently, the front cover 9 begins to pivotally move about the hinge axis J.

The front cover 9 continues to open as the wire W continues to be paid out of the wire take-up device 100 thereafter. When the front cover 9 is in the forward state shown in FIG. 2, exposing the entire access opening 8 of the main casing 2, paying out of the wire W stops.

Specifically, as the front cover 9 is opened, the pulley 160 moves toward the pulley 150. However, when the distance between the pulleys 150 and 160 reaches the distance L2 shown in FIG. 11, the pulley-side stopper piece 179 of the pulley 160 contacts the plate-side stopper part 135 disposed on the pulley retaining plate 120.

Consequently, movement of the pulley 160 toward the pulley 150 is restricted, halting paying out of the wire W.

At this time, the wire W is stretched tight between the main casing 2 and front cover 9. Accordingly, the front cover 9 cannot be opened farther from the position shown in FIG. 2, even if the user continues to push the front cover 9 in the opening direction.

Figure 11:
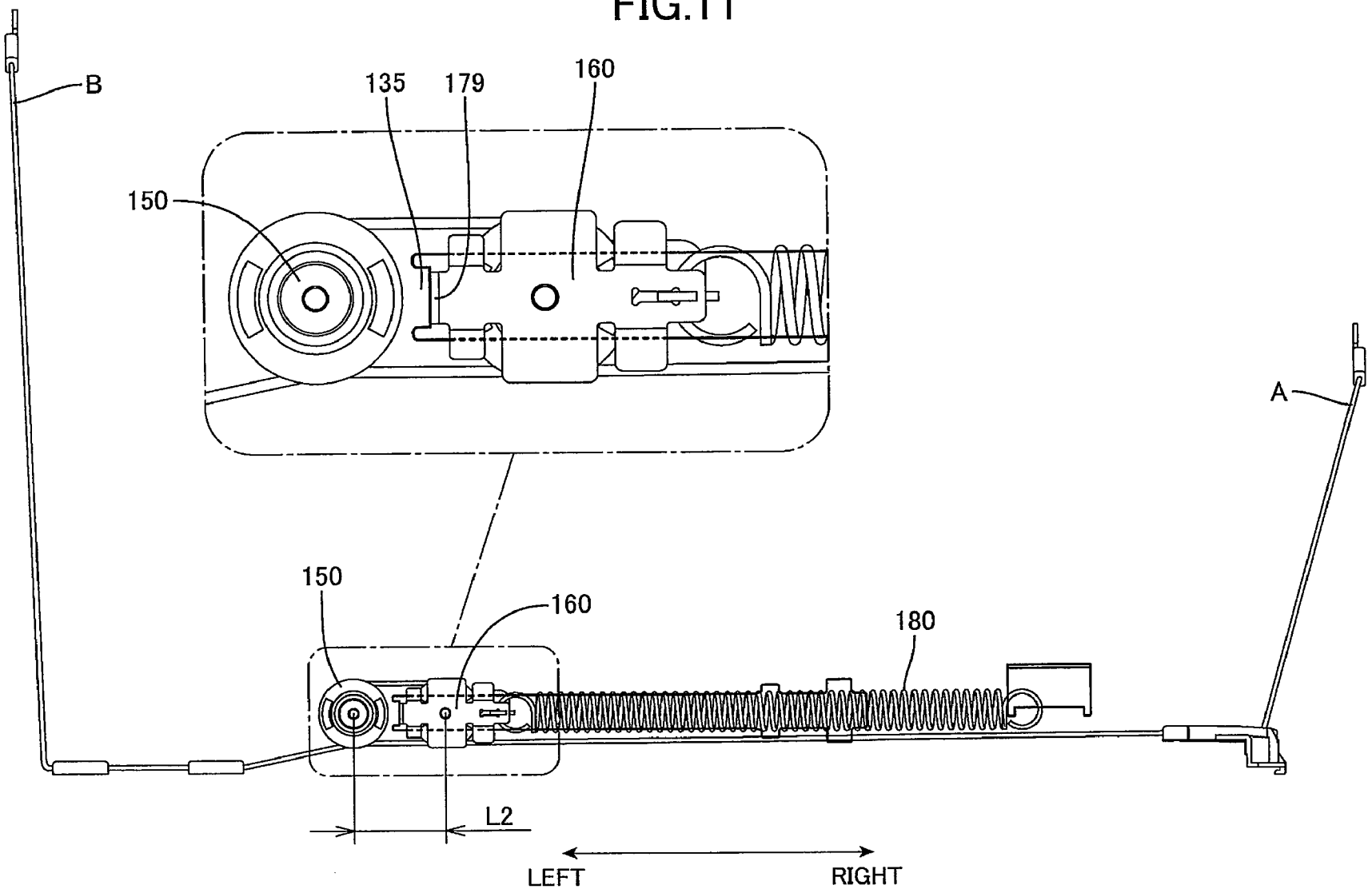
FIG. 11 is a side view showing the positional relationship of the pulleys when the front cover is in a forward state (open state)

In the present embodiment, the elastic force of the coil spring 180 when the coil spring 180 is stretched to the maximum point shown in FIG. 11 is set less than the overall weight of the front cover 9. Accordingly, when the front cover 9 is in the open state, the weight of the front cover 9 overcomes the elastic force of the coil spring 180, maintaining the front cover 9 in the forward state.

However, by adding force to the front cover 9 in the forward state for swingably moving the front cover 9 in the closing direction, the user can return the front cover 9 to its erected state. At this time, unlike during the opening operation, the urging force of the coil spring 180 is added to the force applied for closing the front cover 9, enabling the front cover 9 to be closed with less force than is required in a construction not including the wire take-up device 100. As the closing operation continues and the distance between the main casing 2 and front cover 9 grows smaller, the wire W attached between the main casing 2 and front cover 9 goes slack. However, this slackness is taken up by the wire take-up device 100.

Next, the operations and effects of the above-described first embodiment will be described.

According to the embodiment described above, the printer 1 includes the wire W for coupling the front cover 9 to the main casing 2, and the wire take-up device 100 for producing an elastic force that acts in a direction for taking up the wire W. With this construction, the wire take-up device 100 constantly applies a force of an appropriate magnitude to the front cover 9 via the wire W in the direction for closing the front cover 9. Therefore, when the user opens the front cover 9, the wire take-up device 100 acts to suppress a momentum in the opening direction, so that the front cover 9 is not opened with too much force.

Further, by constantly applying a force of an appropriate magnitude via the wire W, the wire take-up device 100 can suppress a sense of jerking or jolting in the front cover 9.

Further, by disposing the wire take-up device 100 on the inside surface 9C of the front cover 9, which commonly has a lot of unused space, this construction is conducive to forming a more compact device.

Further, the pulley 160 is employed in the present embodiment for letting out and taking up the wire W, and can let out and take up the wire W smoothly. Further, the stroke of movement in the pulley itself can be made small relative to the amount of take-up in the wire W. For example, the stroke of movement in the pulley itself can be made one half of the amount of take-up in the wire W, when one movable pulley (the pulley 160 in the present embodiment) is used. Hence, the wire take-up device 100 can be made more compact.

Further, the wire W is provided on both sides of the front cover 9 in the present embodiment for restraining the opening angle of the front cover 9 on both sides. This construction is effective in preventing left and right twisting in the front cover 9 and can more reliably restrict the opening angle of the front cover 9 than a structure restricting the front cover 9 on only one side. Further, since this structure for restraining the front cover 9 on both sides is implemented with a single wire W, fewer parts are required than a structure that employs two wires.

By forming the wire W of stainless steel, it is possible to provide an opening angle restricting structure that is strong and very reliable. Further, since stainless steel has a conductive property, electricity can be conducted from the front cover 9 to the main casing 2 via the wire W. Therefore, this material is effective as a measure against static electricity (i.e., the wire W enables static electricity in the front cover 9 to be released to the main casing 2).

Further, the pulley holder 170 is employed in the present embodiment as a stopper unit for restricting take-up in the wire W. This construction eliminates the need to provide special parts as the stopper unit, thereby reducing the number of required parts. Since take-up in the wire W can be restricted by preventing relative movement of the pulleys 150 and 160 in the present embodiment, this construction consequently also serves as a measure to prevent interference between the two pulleys.

As described above, the extended position of the wire W in the present embodiment differs on the left and right sides of the hinge axis J. Specifically, the extended position of the wire W on the right side of the device (see FIG. 8) is positioned relatively near the hinge axis J, while the extended position of the wire W on the left side of the device (see FIG. 9) is positioned farther away from the hinge axis J. This arrangement is provided with consideration for the following points.

The weight of the front cover 9 in the present embodiment has a bias between the left and right sides, with the left side in FIG. 2 being heavier than the right side. With this weight bias, the heavy side of the front cover 9 opens with more force than the light side during an opening operation, while a greater force is required to close the heavy side in a closing operation.

To improve the opening and closing operations in this case, it is possible to vary the magnitude of force with which the wire take-up device 100 takes of the wire W between the left and right sides based on the weight bias. This construction can achieve balance in the front cover 9 to facilitate operations.

However, although the wire W is drawn out from both sides of the wire take-up device 100 in the present embodiment, only a single wire W is employed, and the tension generated in the wire W is the same at any point. Consequently, it is not possible to vary the magnitude of the take-up force of the wire W between the left and right sides.

Therefore, the extended positions of the wire W are varied on the left and right sides of the front cover 9 in the present embodiment. Accordingly, even though the magnitude of tension applied via the wire W is the same on both sides of the front cover 9, the lengths La and Lb of the moment arms differ between the left and right sides. In this way, the torque applied to the front cover 9 in the closing direction can be set large on the heavy side and small on the light side, thereby achieving balance in the front cover 9 relative to the weight bias so that the front cover 9 can be opened and closed at any location with the same feeling.

Further, the coil spring 180 can be mounted on the pulley retaining plate 120 in addition to the pulleys 150 and 160 in the present embodiment. Therefore, the wire take-up device 100 is mounted at the same time the pulley retaining plate 120 is mounted on the front cover 9, facilitating assembly.

Second Embodiment

Figure 12:
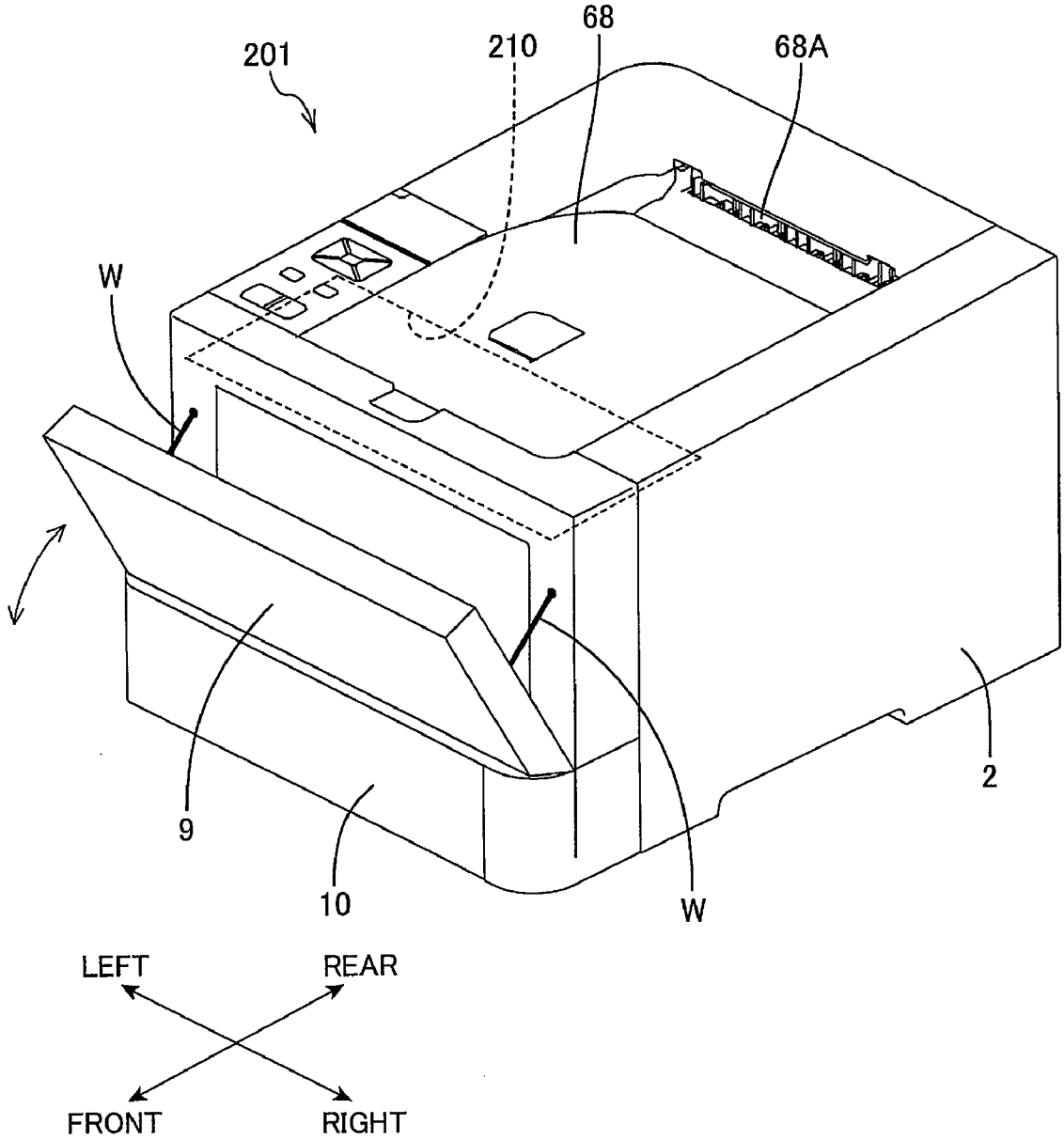
FIG. 12 is a perspective view of a laser printer according to a second embodiment of the invention.

Next, an opening-angle restricting device according to a second embodiment of the invention will be described with reference to FIGS. 12 and 13.

In the second embodiment, rather than disposing the wire take-up device 100 on the front cover 9 as in the first embodiment, a wire take-up device is disposed on the main casing 2. More specifically, in a laser printer 201 shown in FIG. 12, a wire take-up device 210 is disposed beneath the top surface of the main casing 2 (the discharge tray 68).

Figure 13:
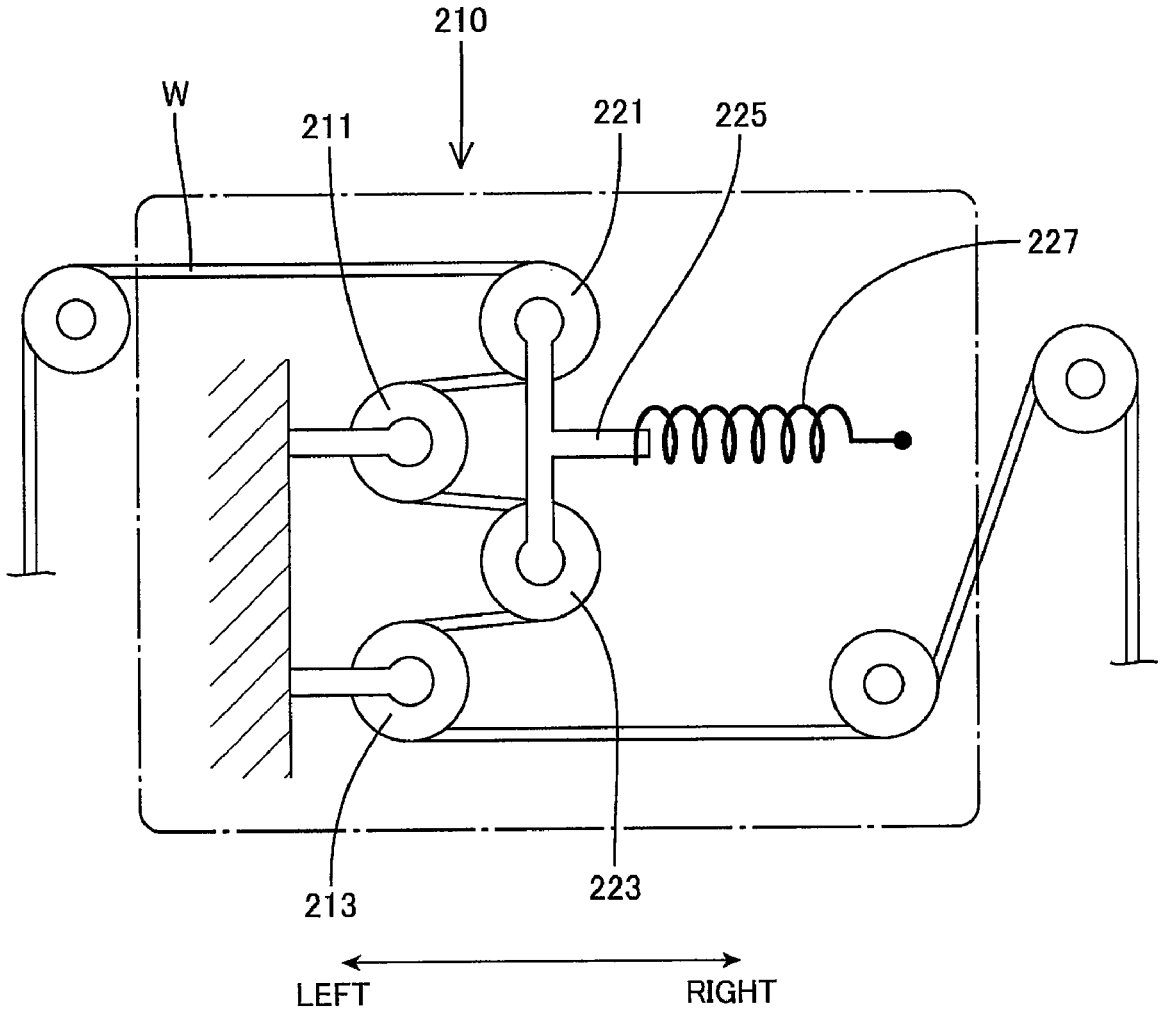
FIG. 13 is an explanatory diagram showing the structure of a wire take-up device in the second embodiment.

As shown in FIG. 13, the wire take-up device 210 includes two fixed pulleys 211 and 213, two movable pulleys 221 and 223, a coil spring 227, and the wire W. The movable pulleys 221 and 223 are attached to a pulley holder 225. The pulley holder 225 is capable of moving in the left and right directions shown in FIG. 13. The coil spring 227 urges the pulley holder 225 toward the right in FIG. 13.

When the pulley holder 225 moves leftward in FIG. 13 against the urging force of the coil spring 227, the distance between the movable pulleys 221 and 223 and the fixed pulleys 211 and 213 is reduced, letting out the wire W. On the other hand, when the pulley holder 225 is moved rightward in FIG. 13, the distance between the movable pulleys 221 and 223 and the fixed pulleys 211 and 213 increases, taking up the wire W.

The remaining structure of the printer 201 is identical to the printer 1 in the first embodiment, and like parts and components are designated with the same reference numerals to avoid duplicating description.

Third Embodiment

Next, an opening-angle restricting device according to a third embodiment of the invention will be described with reference to FIGS. 14 and 15.

In order to restrict the opening angle of the front cover 9, it is necessary to restrict the length of the wire W extending out from the wire take-up device 100 to a predetermined length. This is accomplished in the first embodiment by restricting movement of the pulley 160. Specifically, as shown in FIG. 11, movement of the pulley 160 is restricted when the distance between the pulleys 150 and 160 reaches the distance L2, thereby preventing the wire W from being paid out farther.

In contrast, the third embodiment employs a ball-like protruding part 250 disposed at a predetermined position along the wire W. The length of the wire W extending out from the wire take-up device 100 is restricted to a predetermined length by the protruding part 250 contacting another component.

Figure 14:
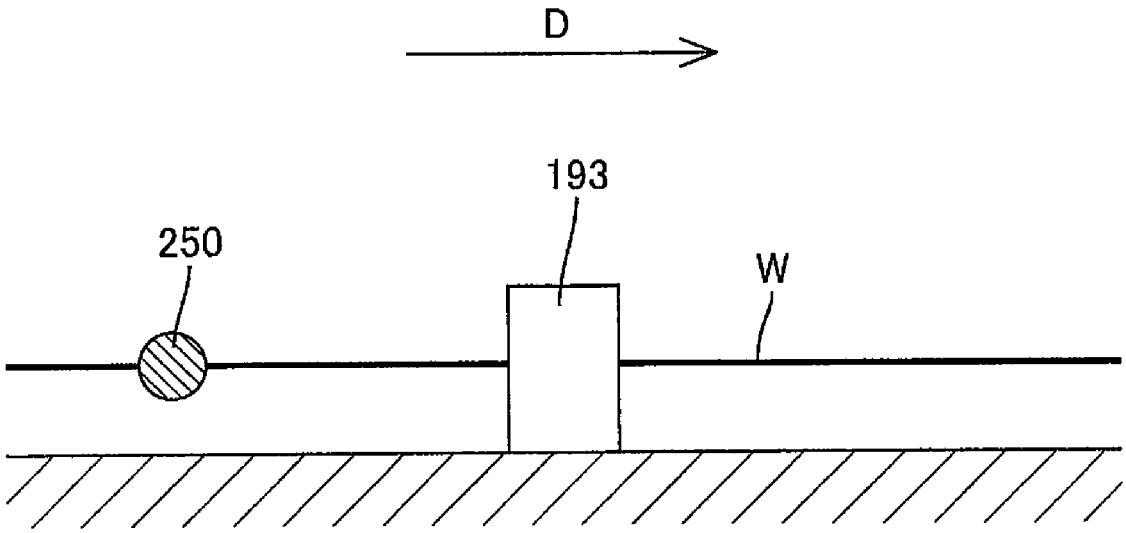
FIG. 14 is an explanatory diagram showing a structure for restricting the wire take-up amount according to a third embodiment of the invention.
Figure 15:
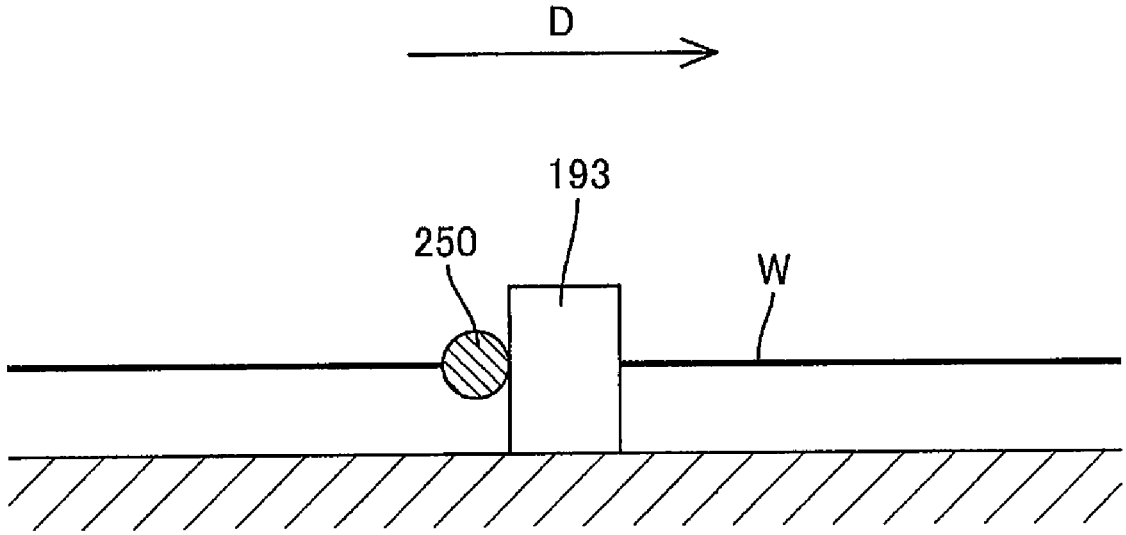
FIG. 15 is an explanatory diagram showing a protruding part in the structure of FIG. 14 contacting a wire support piece to restrict the take-up amount of the wire.

In the examples of FIGS. 14 and 15, the wire support piece 193 serves as a component contacted by the protruding part 250 (restricting part). As the wire W is paid out from the wire take-up device 100 during an opening operation, the protruding part 250 also moves integrally with the wire W toward the main casing side. The protruding part 250 is positioned to contact the wire support piece 193 when the amount of payout in the wire W has reached the predetermined length, thereby restricting the wire W from being further paid out from the wire take-up device 100.

With this construction, the protruding part contacts the restricting part (the wire support piece in the above example) when the length of the string member (the wire in the above example) paid out from the take-up device reaches a predetermined length, thereby restricting the paid out length of the string member.

Providing the structure for restricting the paid out amount of wire W in a location other than the pulleys in this way is advantageous in that the paid out amount of the wire W, i.e. the degree of angle to which the front cover opens, can be set to various amounts simply by setting the position of the protruding part 250, while a common set of pulleys can be used for all settings. Further, since the location of the protruding part 250 can be selected with relative freedom, the protruding part 250 can be easily provided in a position that avoids interference with other parts.

While the invention has been described in detail with reference to the above aspects thereof, it would be apparent to those skilled in the art that various changes and modifications may be made therein without departing from the spirit of the invention.

(1) While a front cover is the object with which the opening angle is restricted in the first through third embodiments described above, this object may be any cover provided on an image forming apparatus (a laser printer in the above-described embodiments, but any apparatus that forms images on a recording medium). For example, the invention may be applied to a rear cover or the like provided on the rear surface of the apparatus.

(2) While the wire take-up device in the first embodiment is a pulley device comprising a fixed pulley and a movable pulley, the invention may be applied to any device capable of taking up a wire. For example, the wire may be taken up by rotating a take-up shaft. In this case, a windup spring (urging means) may be attached to the take-up shaft for rotating the same.

(3) A double-sided take-up device is used in the first embodiment for restricting both sides of the cover, but two single-sided take-up devices may be provided to implement the same function.

What is claimed is:

1. An opening-angle restricting device comprising:

a main casing having an inner space for accommodating an image forming unit that forms an image on a recording medium;

a cover member coupled to the main casing via a hinge, the cover member having an inner side that faces the inner space when the cover member is closed;

a string member having one end fixed to the main casing;

a take-up unit provided at the inner side of the cover member, the take-up unit being configured to pay out and take up the string member; and a stopper unit that restricts paying out of the string member when an amount of payout in the string member reaches a predetermined amount, thereby restricting an opening angle of the cover member at a predetermined angle, wherein the cover member is swingably movable about a swing axis that extends in an axial direction, and wherein both ends of the string member are fixed to respective ends of the main casing in the axial direction.

2. The opening-angle restricting device according to claim 1, wherein the take-up unit comprises:

a plurality of pulleys including at least one movable pulley that is movable in a first direction and in a second direction opposite the first direction; and an urging member that urges the at least one movable pulley to move in the first direction for taking up the string member; and wherein the take-up unit is configured such that the string member is taken up by movement of the at least one movable pulley in the first direction and that the string member is paid out by movement of the at least one movable pulley in the second direction.

3. The opening-angle restricting device according to claim 2, wherein the string member is looped around the plurality of pulleys such that the both ends of the string member are capable of being paid out from the take-up unit.

4. The opening-angle restricting device according to claim 3, wherein the hinge is provided at a lower part of the cover member when the main casing is disposed in an orientation in which the main casing is intended to be used, allowing the cover member to swingably open at an upper side;

wherein the cover member has different weights at both sides in the axial direction;

wherein the one end of the string member is fixed to a corresponding one of the ends of the main casing such that a distance between the string member and the swing axis equals to a first distance; and wherein another end of the string member is fixed to another one of the ends of the main casing such that a distance between the string member and the swing axis equals to a second distance longer than the first distance, the another one of the ends of the main casing corresponding to a heavier side of the cover member.

5. The opening-angle restricting device according to claim 3, further comprising:

a pulley holder that holds the at least one movable pulley and that has a first stopper part; and a second stopper part that is provided separately from the pulley holder, wherein, when the amount of payout in the string member reaches the predetermined amount, the first stopper part contacts the second stopper part for restricting the movement of the at least one movable pulley, thereby restricting further paying out of the string member.

6. The opening-angle restricting device according to claim 1, further comprising:

a protruding part provided on the string member; and a restricting part provided on a path along which the string member is paid out and taken up, wherein, when the amount of payout in the string member reaches the predetermined amount, the protruding part contacts the restricting part, thereby restricting further paying out of the string member.

7. The opening-angle restricting device according to claim 1, wherein the string member is configured of thread wire made of stainless steel.

8. The opening-angle restricting device according to claim 1, wherein the take-up unit comprises:

a pulley retaining member that extends in an axial direction in which a swing axis of the cover member extends, the pulley retaining member having a first end and a second end opposite the first end in the axial direction, the pulley retaining member being provided with a mounting seat adjacent to the first end and with a first spring engaging part adjacent to the second end, the pulley retaining member being formed with a guide groove that extends in the axial direction between the mounting seat and the first spring engaging part;

a fixed pulley that is rotatably supported by the mounting seat;

a pulley holder that engages the guide groove and that is slidingly movable along the guide groove, the pulley holder having a second spring engaging part;

a movable pulley that is rotatably supported by the pulley holder; and a coil spring that is configured to expand and contract in the axial direction, the coil spring having one end engaged with the first spring engaging part and another end engaged with the second spring engaging part, wherein the take-up unit is configured such that the string member is taken up when the coil spring contracts to move the movable pulley in a direction toward the second end, and that the string member is paid out when the movable pulley is moved toward the first end to expand the coil spring.

* * * * *